US008596056B2

(12) United States Patent
Woodmansee et al.

(10) Patent No.: US 8,596,056 B2
(45) Date of Patent: Dec. 3, 2013

(54) CONFIGURABLE HYDRAULIC SYSTEM

(75) Inventors: Michael Woodmansee, Houston, TX (US); Philip Zsiga, Stafford, TX (US); Josh Rayner, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 972 days.

(21) Appl. No.: 12/572,336

(22) Filed: Oct. 2, 2009

(65) Prior Publication Data

US 2010/0083649 A1 Apr. 8, 2010

Related U.S. Application Data

(60) Provisional application No. 61/195,120, filed on Oct. 3, 2008.

(51) Int. Cl.
*F15B 11/17* (2006.01)

(52) U.S. Cl.
USPC ..... 60/428; 60/486; 166/285

(58) Field of Classification Search
USPC ..... 60/428, 486; 166/250.14, 281, 285
See application file for complete search history.

(56) References Cited

U.S. PATENT DOCUMENTS

| | | | | |
|---|---|---|---|---|
| 3,602,308 | A * | 8/1971 | Vincent | 166/281 |
| 4,000,616 | A | 1/1977 | Symmank | |
| 4,345,436 | A * | 8/1982 | Johnson | 60/428 |
| 4,538,221 | A | 8/1985 | Crain et al. | |
| 4,538,222 | A | 8/1985 | Crain et al. | |
| 4,553,599 | A | 11/1985 | Glotin | |
| 6,264,128 | B1 | 7/2001 | Shampine et al. | |
| 6,382,595 | B1 | 5/2002 | Nold, III | |
| 6,585,232 | B2 | 7/2003 | Rechenmacher et al. | |
| 6,920,936 | B2 | 7/2005 | Sheiretov et al. | |
| 7,013,971 | B2 * | 3/2006 | Griffith et al. | 166/285 |
| 7,032,887 | B2 | 4/2006 | Mert et al. | |
| 7,464,757 | B2 | 12/2008 | Pessin et al. | |
| 7,740,447 | B2 * | 6/2010 | Pessin et al. | 415/206 |
| 2007/0295509 | A1 | 12/2007 | Pessin et al. | |

* cited by examiner

*Primary Examiner* — Thomas E Lazo
(74) *Attorney, Agent, or Firm* — Myron K. Stout; Daryl Wright; Tim Curington

(57) ABSTRACT

A configurable hydraulic system facilitates a variety of oilfield cementing and other oilfield or related applications. The system employs a plurality of prime movers to drive a plurality of loads. The plurality of prime movers and loads are coupled with a configurable hydraulic system that maintains a separate, sealed hydraulic system associated with each prime mover. The configurable hydraulic system also enables the load configuration driven by each prime mover to be changed without losing the benefit of a separate, sealed hydraulic system associated with each specific prime mover.

24 Claims, 6 Drawing Sheets

CONFIGURABLE HYDRAULIC SYSTEM

CROSS-REFERENCE TO RELATED APPLICATION

The present document is based on and claims priority to U.S. Provisional Application Ser. No. 61/195,120, filed Oct. 3, 2008.

BACKGROUND

In mixing and pumping cement for the oil drilling and production industry, centrifugal pumps are used for low-pressure pumping of cement slurry. These pumps may be direct driven by using a driveline that runs from a transmission mounted or engine mounted power takeoff to the pump shaft. In other applications, the pumps are driven electrically by mounting an electric motor directly to the pump frame, or the pumps may be driven hydraulically using a hydraulic pump mounted to a power takeoff that transmits power to a hydraulic motor mounted directly to the centrifugal pump.

Each mode of power transmission has advantages and disadvantages. Direct drive systems benefit from high efficiency, simplicity and relatively low weight, although driveline angle restrictions limit where the driven loads may be placed. Electric drive systems provide smooth, quiet operation but such systems are heavy and require a source of substantial electrical power. Hydraulic drive systems are lighter than electric drive systems and provide greater flexibility in load placement and orientation, but they can be vulnerable to oil contamination and other potential problems.

A conventional oilfield cementing unit with fail-safe capability typically employs full redundancy of all components important to operation. For example, if a prime mover, two centrifugal pumps and a triplex pump are required to mix and pump cement in a given cementing unit design, then the conventional redundant, fail-safe system employs two prime movers, four centrifugal pumps, and two triplex pumps. Commonly, each of the centrifugal pumps is direct-driven from a power takeoff and each power takeoff is dedicated to the particular centrifugal pump. The fully redundant system may be overly conservative because it is unlikely that of two operating centrifugal pumps, both would fail within the same job and thereby require both backup pumps to be utilized. Furthermore, the fully redundant system may present new reliability risks that are not present in a non-redundant system due to, for example, damage to or plugging of the additional piping required to plumb the backup pumps into the cementing system.

Driveline systems are known in which a power takeoff drives exactly one output without the ability to exchange pump loads between power sources. The placement and orientation of the pumps are limited by the driveline angle, and the path of the driveline limits the options for placement of major components. Sometimes, right-angle gearbox systems are employed in conjunction with drivelines to increase the number of locations in which the pumps may be placed. However, the additional gearbox adds a failure point, reduces the overall drivetrain reliability and efficiency, and creates an additional need for a gearbox lubrication and cooling system, thus increasing system complexity.

Additionally, closed-loop systems have been employed between a power source and a hydraulic pump. However, existing closed-loop systems do not work well in redundant systems because of the lack of system isolation and because of the additional components and complexity of such systems. In some applications, close-coupled hydraulic systems are employed in which a closed-loop hydraulic pump and a motor are mounted together both mechanically and hydraulically. However, such approaches provide no option for switching between different loads. Open-loop hydraulic systems also have been employed in various applications, however open-loop systems typically require hydraulic reservoirs that are significantly larger than those for closed-loop hydraulic systems.

SUMMARY

In general, the present invention provides a system and methodology for powering a variety of oilfield or well-related applications, such as well cementing applications. The system and methodology employ a plurality of prime movers to drive a plurality of loads. The number of loads may be greater than the number of prime movers; however the prime movers may be selectively coupled with different load configurations. The plurality of prime movers and loads are coupled with a hydraulic system that maintains a separate, sealed hydraulic system associated with each prime mover. The hydraulic system also enables the load configuration driven by each prime mover to be changed without losing the benefit of a separate, sealed hydraulic system associated with that specific prime mover.

BRIEF DESCRIPTION OF THE DRAWINGS

Certain embodiments of the invention will hereafter be described with reference to the accompanying drawings, wherein like reference numerals denote like elements, and.

DETAILED DESCRIPTION

In the following description, numerous details are set forth to provide an understanding of the present invention. However, it will be understood by those of ordinary skill in the art that the present invention may be practiced without these details and that numerous variations or modifications from the described embodiments may be possible.

Embodiments of a system and method for delivering power to a plurality of loads utilized in an oilfield or well-related application are disclosed. In an embodiment, the system is a configurable power delivery system designed to supply power for an oilfield cementing unit. However, the system and methodology enables use of a configurable system to supply power to a variety of loads.

In one example, the power delivery system comprises a plurality, e.g. two, prime movers that each have a separate, sealed hydraulic system. The prime movers supply power to a plurality of loads, e.g. three loads. In the oilfield cementing application, the plurality of loads may comprise a plurality of pumps, such as centrifugal pumps designed to deliver cement slurry downhole. Other than the oilfield cementing application, the present system and methodology may be used in a variety of closed-loop hydraulic systems employing two or more prime movers and two or more loads with the capability of exchanging which loads are driven by each prime mover while maintaining separate, sealed hydraulic systems associated with each prime mover. The prime movers may be powered via a variety of sources for mechanical work, including diesel engines, gasoline engines, electric motors, and other suitable sources. Similarly, the loads may comprise a variety of load types, including fluid pumps, actuators, hydraulically driven components, or other loads requiring power.

Figure 1:
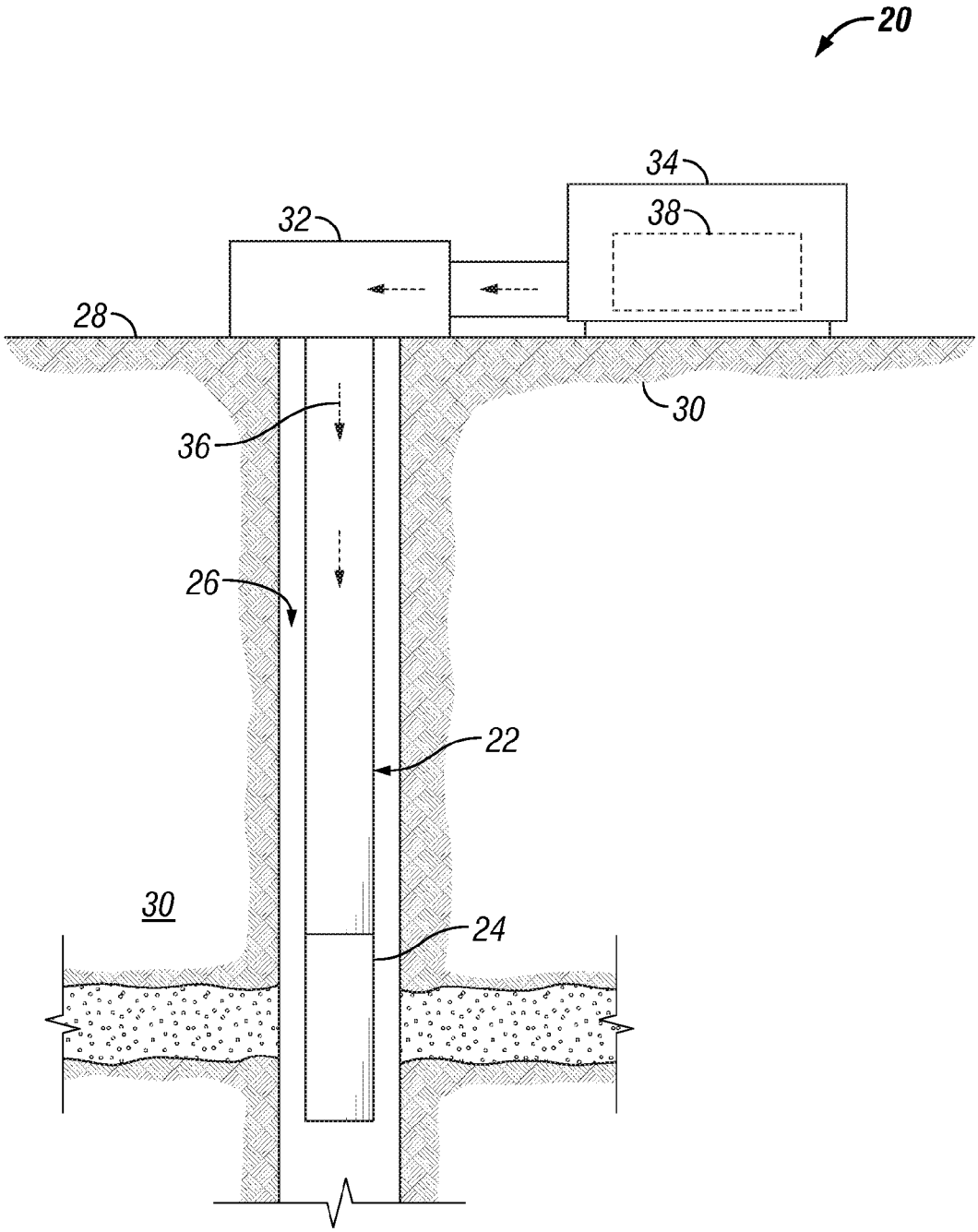
FIG. 1 is a schematic view of one example of a well system.

Referring generally to FIG. 1, an embodiment of a well system 20 is illustrated. In this embodiment, a well string 22 having, for example, a cementing completion 24 is deployed in a wellbore 26. The wellbore 26 extends downwardly from a surface location 28 and into a subterranean formation 30. A wellhead 32 may be deployed at surface location 28 above wellbore 26. Wellsite surface equipment 34, such as an oilfield cementing unit 34 is connected to wellhead 32 for delivery of cement slurry 36 downhole to enable performance of a desired cementing operation.

The oilfield cementing unit 34 comprises a configurable power delivery system 38 to deliver the slurry 36 downhole while providing easy, selective reconfiguration of the power delivery system components, as described in greater detail below. The ability to selectively reconfigure the components of system 38 provides an efficient redundancy of components that enables continuation of the cementing operation regardless of the failure of individual components. However, the redundancy is provided without duplicating all of the major system components. It should again be noted that the configurable power delivery system may be used in a variety of well applications and is not limited to the oilfield cementing application described above. The configurable power delivery system may be utilized with other system including wellsite surface equipment such as, but not limited to, fracturing pumps/systems, liquid additive pumps/system, or other oilfield service units. The configurable power delivery system may be utilized in conjunction with the surface equipment to perform at least one well services operation including, but not limited to, a fracturing operation, an acid treatment operation, a cementing operation, a well completion operation, a sand control operation, a coiled tubing operation, and combinations thereof.

Figure 2:
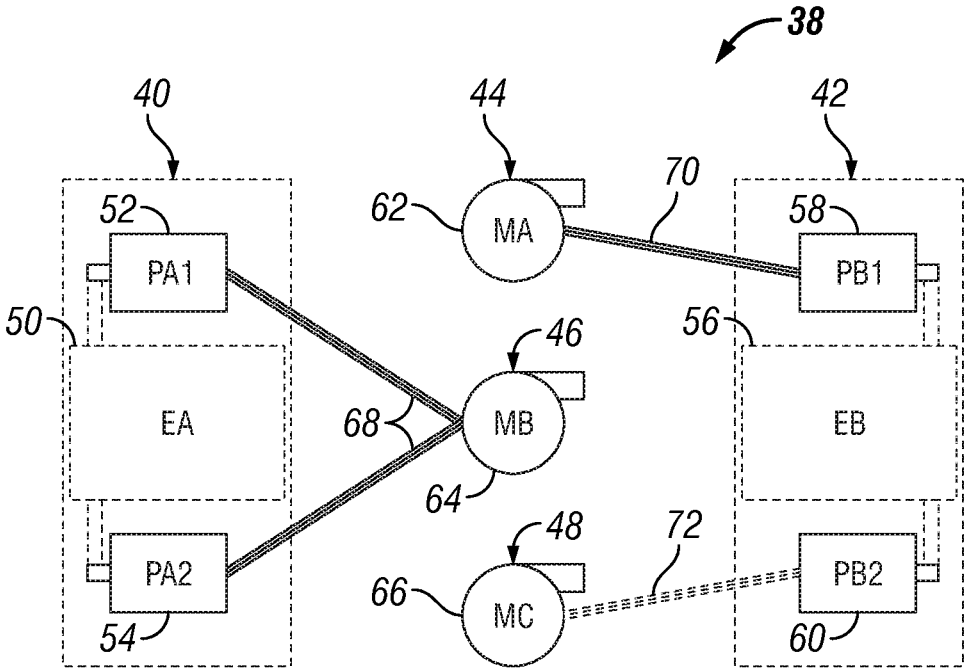
FIG. 2 is an illustration of an embodiment of a multi-configuration power delivery system that can be used to deliver power to a plurality of loads.

Referring generally to FIG. 2, one example of a configurable power delivery system 38 is illustrated. In the embodiment illustrated, system 38 comprises a first prime mover 40 and a second prime mover 42 designed to drive a plurality of loads, such as loads 44, 46 and 48. The first prime mover 40 is illustrated as having a power source 50, such as a diesel engine, gasoline engine, electric motor or other suitable power source, coupled to variable displacement hydraulic pumps 52, 54. Similarly, the second prime mover 42 comprises a power source 56 coupled to variable displacement hydraulic pumps 58, 60. However, the number of prime movers, the number of prime mover components, and the arrangement of prime mover components can vary from one application to another.

In the example illustrated, the loads 44, 46, 48 may comprise centrifugal pumps 62, 64, 66, respectively, for pumping cement slurry or other substances. However, the loads may comprise a variety of other components for other applications. In the present embodiment, the variable displacement hydraulic pumps are operatively coupled with the respective loads 44, 46, 48 in a variety of configurations for various operational scenarios. In a first normal operating configuration, for example, load 46 operates in combination with either load 44 or load 48 and the other of load 44 and load 48 serves as a backup. For example, initial operation may utilize load 46 in combination with load 44, in which load 46 is sized to require two variable displacement hydraulic pumps, e.g. pumps 52, 54, to operate at full power. The load 48 is then used as a backup load that can replace either load 46 or load 44. The illustrated system maintains fail-safe operation, while minimizing the number of driven loads and reducing the number of potential failure points in the overall system. In an embodiment, the loads, 44, 46, 48 may be coupled to hydraulic motors for receiving hydraulic power from the variable displacement hydraulic pumps 52, 54, 58, or 60 for driving the loads, as will be appreciated by those skilled in the art.

In the first operational scenario illustrated in FIG. 2, first prime mover 40, with variable displacement hydraulic pumps 52, 54, drives load 46 via hydraulic lines 68. Simultaneously, second prime mover 42, with variable displacement hydraulic pumps 58, 60, drives load 44 using variable displacement hydraulic pump 58 via hydraulic line 70. The backup load 48 may be hydraulically connected to variable displacement hydraulic pump 60 as illustrated by dashed line 72, although pump 60 generates no flow and transmits no power to load 48 while serving as backup. In this configuration, each prime mover 40/42 is associated with a separate, sealed hydraulic system as explained in greater detail below.

Figure 3:
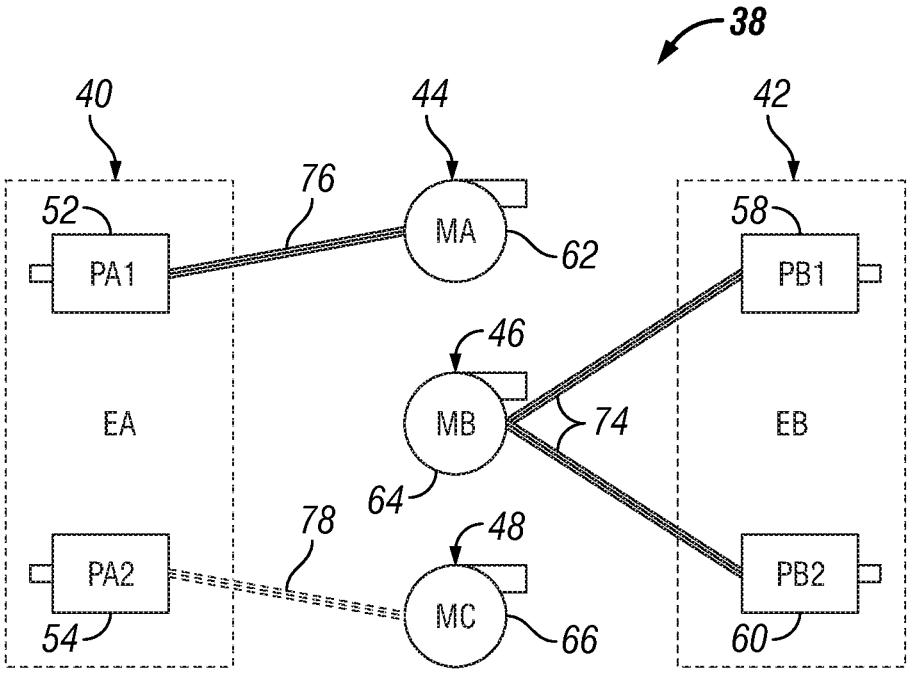
FIG. 3 is an illustration similar to that of FIG. 2 but showing the system in a different configuration.

Referring generally to FIG. 3, a second normal operational configuration is illustrated. In this embodiment, the second prime mover 42, with variable displacement hydraulic pumps 58, 60, drives load 46 via hydraulic lines 74. The load 46 is again sized to utilize two variable displacement hydraulic pumps to operate at full power. Simultaneously, first prime mover 40, with variable displacement hydraulic pumps 52, 54, drives load 44 using variable displacement hydraulic pump 52 via hydraulic line 76. The backup load 48 may be hydraulically connected to variable displacement hydraulic pump 54 as illustrated by dashed line 78, although pump 54 generates no flow and transmits no power to load of 48 while serving as backup. In this second configuration, each prime mover 40/42 is again associated with a separate, sealed hydraulic system. It should be noted that in FIG. 3 and subsequent figures, the power sources 50, 56 used to run the variable displacement hydraulic pumps have not been illustrated.

Figure 4:
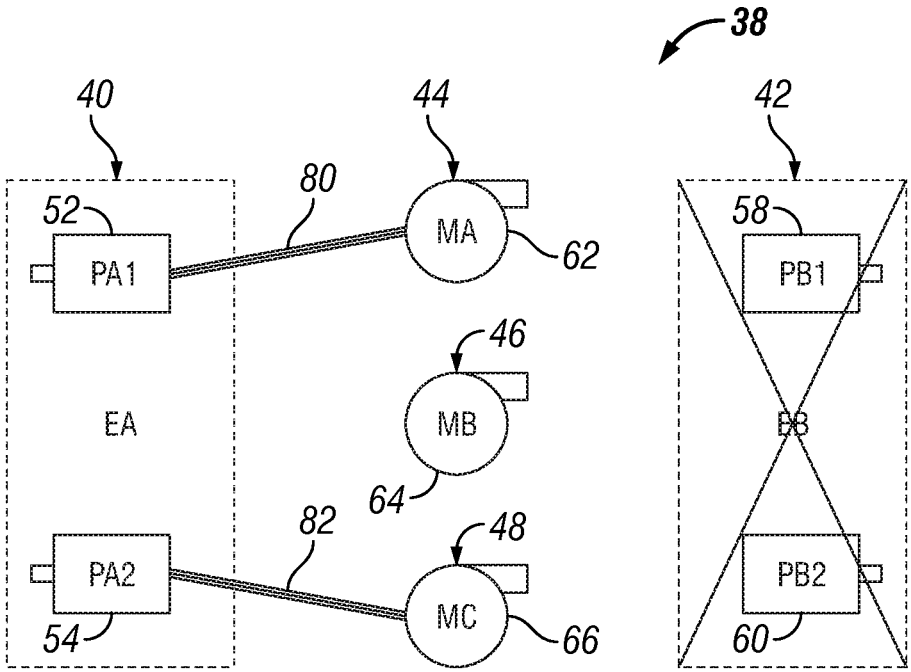
FIG. 4 is an illustration similar to that of FIG. 2 but showing the system in a different configuration.

Sometimes the servicing of components or component failure may require selectively changing configurable power delivery system 38 to a backup configuration. In FIG. 4, one example of a backup configuration is illustrated and may be achieved through a simple, automatic adjustment of the hydraulic system coupling prime movers 40, 42 with loads 44, 46, 48. In the backup configuration of FIG. 4, second prime mover 42, with variable displacement hydraulic pumps 58, 60, is inactive which removes pumps 58, 60 from service. To accommodate the inactive status of second prime mover 42, the hydraulic coupling of first prime mover 40 with loads 44, 46, 48 is changed. By way of specific example, variable displacement hydraulic pump 52 is used to power load 44 via hydraulic line 80. Simultaneously, variable displacement hydraulic pump 54 is used to power load 48 (formerly the backup load) via hydraulic line 82.

Figure 5:
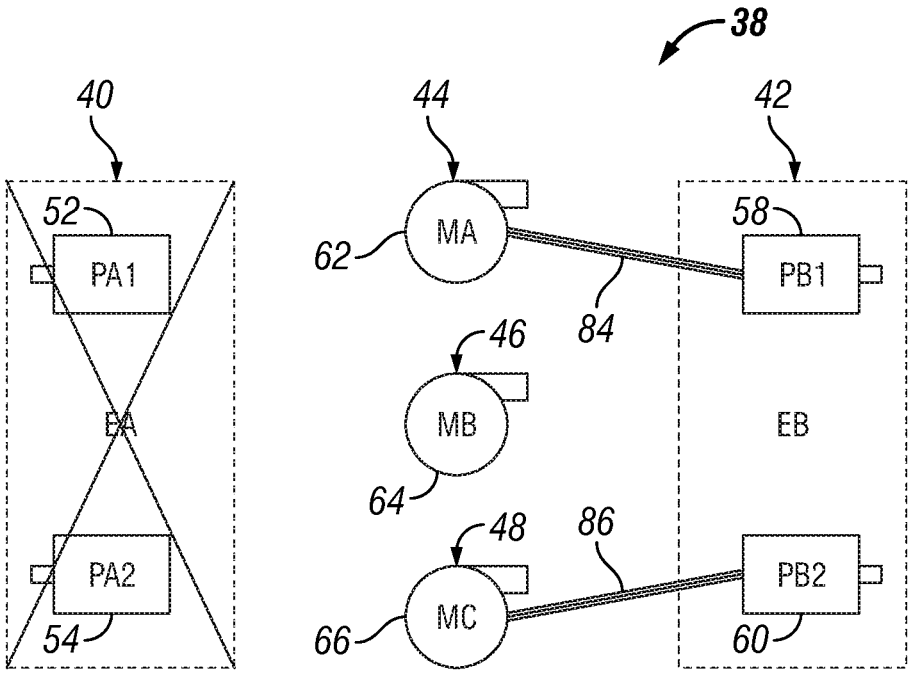
FIG. 5 is an illustration similar to that of FIG. 2 but showing the system in a different configuration.

However, a variety of backup configurations are available and may be utilized. In FIG. 5, for example, a second example of a backup configuration is illustrated and may be achieved through a simple, automatic adjustment of the hydraulic system coupling prime movers 40, 42 with loads 44, 46, 48. In this second backup configuration, first prime mover 40, with variable displacement hydraulic pumps 52, 54, is inactive which removes pumps 52, 54 from service. To accommodate the inactive status of first prime mover 40, the hydraulic coupling of second prime mover 42 with loads 44, 46, 48 is changed. By way of specific example, variable displacement hydraulic pump 58 is used to power load 44 via hydraulic line 84. Simultaneously, variable displacement hydraulic pump 60 is used to power load 48 (formerly the backup load) via hydraulic line 86.

Figure 6:
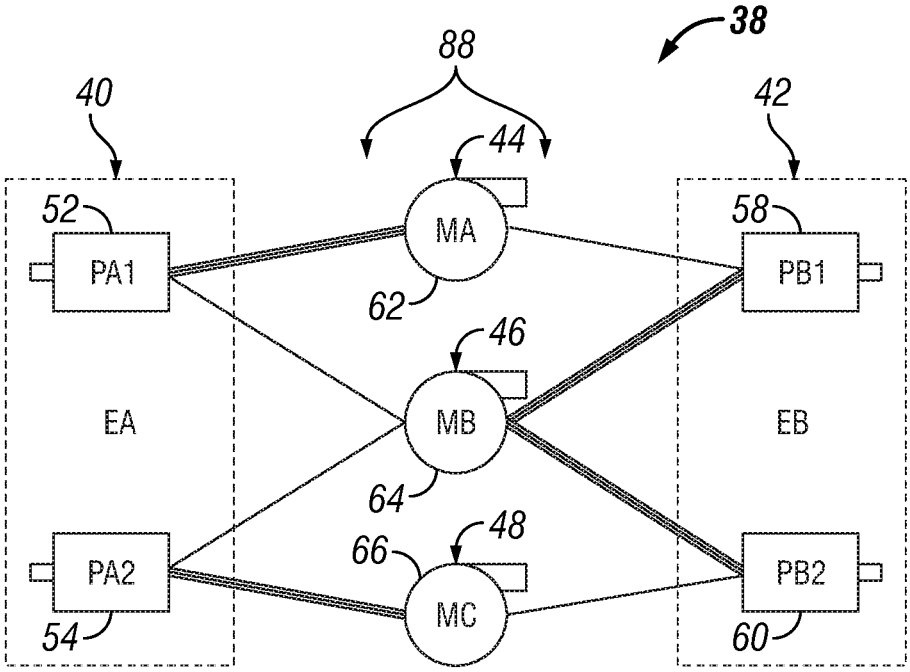
FIG. 6 is an illustration similar to that of FIG. 2 but showing the system in a different configuration.

The four operational scenarios/configurations discussed above with reference to FIGS. 2-5 may be attained by employing one of two hydraulic configurations shown in FIG. 6. In the first normal operating configuration, variable displacement hydraulic pumps 52, 54 of first prime mover 40 are each linked to or drive load 46, and variable displacement hydraulic pumps 58, 60 of second prime mover 42 are linked to or drive loads 44 and 48, respectively. In the second normal operating configuration, variable displacement hydraulic pumps 52, 54 are linked to or drive loads 44 and 48, respectively, and variable displacement hydraulic pumps 58, 60 are both linked to or drive load 46.

The first normal operational configuration also is illustrated in FIG. 2 and may be accomplished by running both first prime mover 40 and second prime mover 42 while de-stroking variable displacement hydraulic pump 60 to avoid transmission of power to load 48. The second normal operational configuration also is illustrated in FIG. 3 and is accomplished by running both first prime mover 40 and second prime mover 42 while de-stroking variable displacement hydraulic pump 54 to avoid transmission of power to load 48. The first backup operational configuration (see FIG. 4) is accomplished by running only first prime mover 40, and the second backup operational configuration (see FIG. 5) is accomplished by running only second prime mover 42. As illustrated in FIG. 6, a configurable hydraulic system 88 enables easy, automatic reconfiguring of the hydraulic lines to enable operation of the system in any of the normal or backup configurations while maintaining separate, sealed hydraulic systems associated with each prime mover.

In embodiments in which pumps 52, 54, 58 and 60 are designed as variable displacement hydraulic pumps, the loads 44, 46, 48 may be of different sizes. However, if the loads are different sizes, variable displacement hydraulic pumps 52 and 58 are designed with sufficiently large capacity to drive load 44. Similarly, pumps 54 and 60 are designed with sufficiently large capacity to drive load 48. The sum of the flows produced by pump 52 and pump 54 also should be large enough to drive load 46. Additionally, the sum of the flows produced by pump 58 and pump 60 should be large enough to drive load 46.

Figure 7:
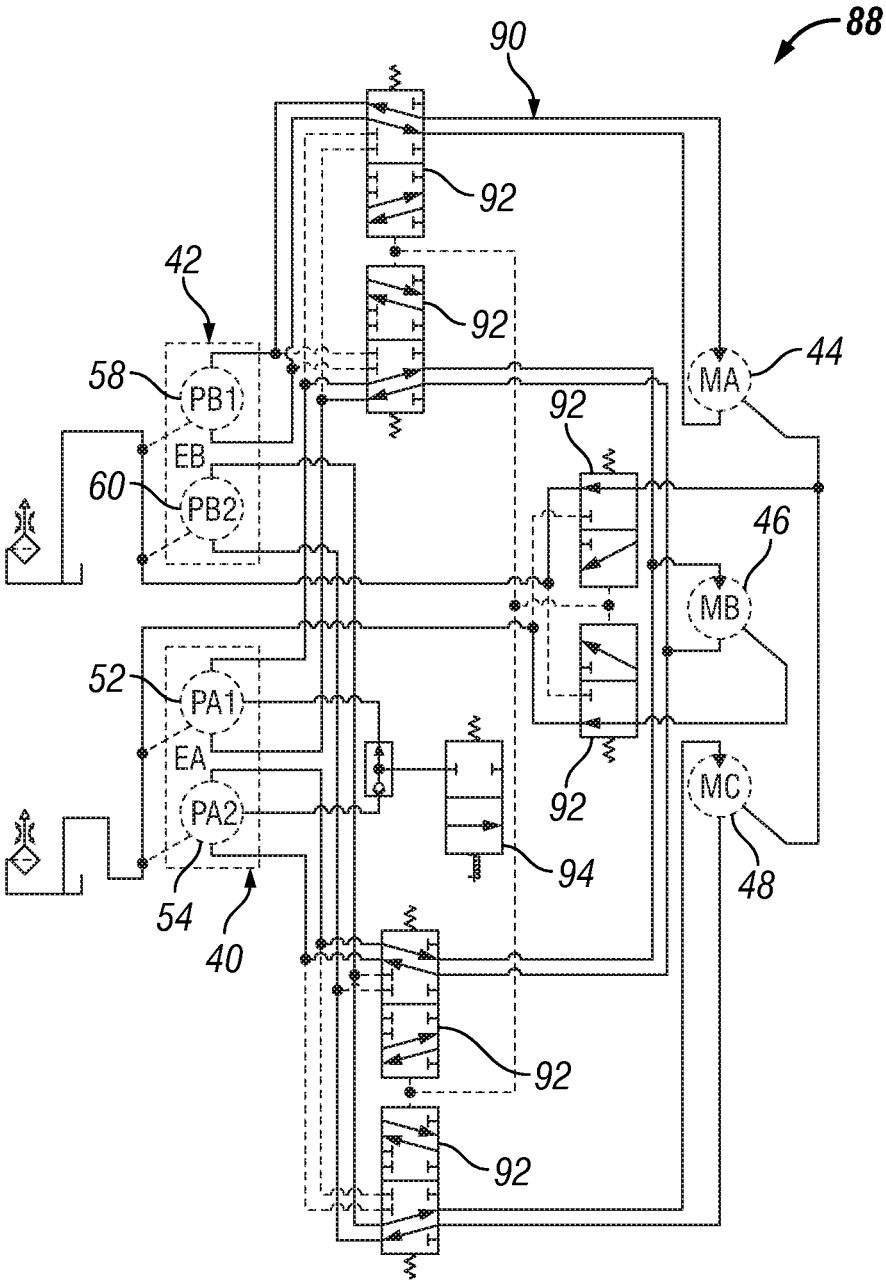
FIG. 7 is an illustration of an embodiment of a configurable hydraulic system that can be used to switch the multi-configuration power delivery system between configurations.

Referring generally to FIG. 7, one example of configurable hydraulic system 88 is illustrated. In the illustrated embodiment, configurable hydraulic system 88 is embodied in a single valve 90 having a plurality of valve switches 92. By way of example, the plurality of valve switches 92 may be activated to transition valve 90 between valve states which, in turn, control the configurations of power delivery system 38. The activation of valve switches 92 may be achieved with a binary signal such that the simple binary signal can be used to selectively reconfigure power delivery system 38.

The binary signal may be a hydraulic signal, pneumatic signal, mechanical signal, electrical signal or other suitable signal. In some applications, the conversion of power delivery system 38 between configurations, such as between the first normal configuration and the second normal configuration discussed above, can be achieved with a single control valve 94 that controls the actuation of valve switches 92 via flow of fluid. The control valve 94 may comprise a solenoid valve and may be controlled mechanically, hydraulically, electrically, or via another suitable medium. The arrangement of valve switches 92 and other components within single valve 90 enables maintenance of separate, hydraulic systems associated with each prime mover 40 and 42 regardless of the configuration of power delivery system 38. This maintenance of separate, hydraulic systems isolates the prime movers from each other such that the working fluids do not mix and cross-contamination does not occur. The conversion of the power delivery system 38 may be achieved by manual or hand operation of valves associated with such a conversion such as valves 90, 92, and/or 94, as will be appreciated by those skilled in the art.

In the embodiment illustrated in FIG. 7, the automatically configurable hydraulic system 88 is in a first state or configuration that results when control valve 94 is de-energized/closed. Under such conditions, each of the valve switches 92 is biased to a first position, as illustrated. The flow of fluid from the variable displacement hydraulic pumps to the loads is illustrated by solid lines while dashed lines correspond to lines with no flow. The flow of fluid represented by solid lines reflects an overall power delivery system configuration similar to that illustrated schematically in FIG. 2. For example, variable displacement hydraulic pumps 52 and 54 of prime mover 40 are hydraulically coupled with load 46 to drive load 46, e.g. centrifugal pump 64. Simultaneously, variable displacement hydraulic pump 58 of prime mover 42 is hydraulically coupled with load 44 to drive load 44, e.g. centrifugal pump 62. Similarly, variable displacement pump 60 of prime mover 42 is hydraulically coupled with load 48, e.g. centrifugal pump 48. As described above, however, load 48 may be used as a backup load in which case variable displacement hydraulic pump 60 is not operated so that no power is transferred to load 48.

Figure 8:
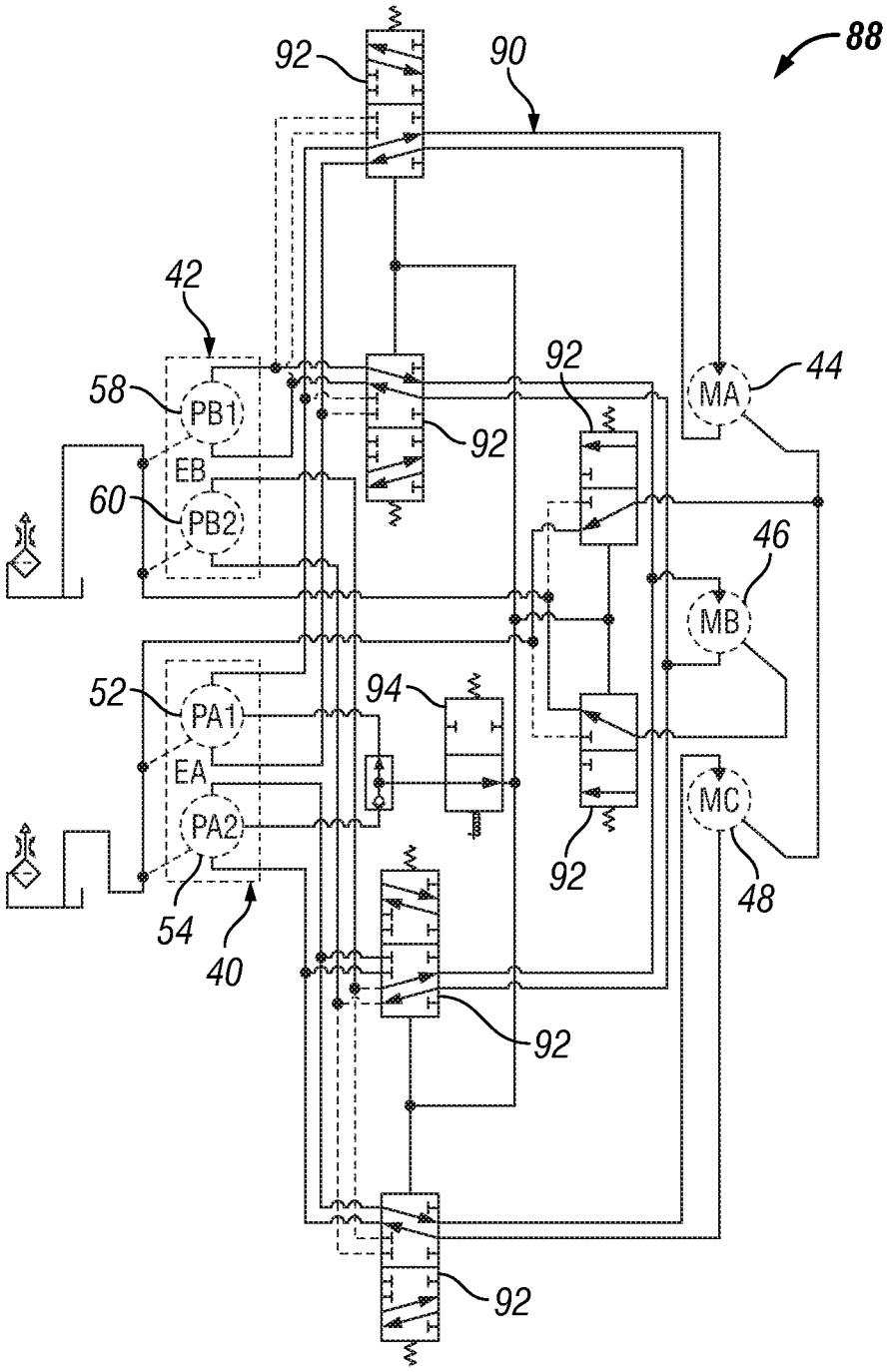
FIG. 8 is an illustration similar to that of FIG. 7 but showing the configurable hydraulic system actuated to a different configuration.

When control valve 94 is energized/opened, the binary signal is provided to the valve switches 92 which transition to a second state, as illustrated in FIG. 8. Transition to this second state also causes a change in configuration of power delivery system 38 from the first normal operating configuration illustrated schematically in FIG. 2 to the second normal operating configuration illustrated schematically in FIG. 3. For example, variable displacement hydraulic pumps 58 and 60 of prime mover 42 are hydraulically coupled with load 46 to drive load 46. Simultaneously, variable displacement hydraulic pump 52 of prime mover 40 is hydraulically coupled with load 44 to drive load 44. Similarly, variable displacement pump 54 of prime mover 40 is hydraulically coupled with load 48. As described above, however, load 48 may be used as a backup load in which case variable displacement hydraulic pump 54 is not operated so that no power is transferred to load 48.

In both states/configurations illustrated in FIGS. 7 and 8, the oil drawn from a reservoir (suction lines not shown) is returned to the same reservoir. This maintains isolation of the two active hydraulic systems that are independently associated with first and second prime movers 40, 42, respectively. Additionally, valve switches 92 may be formed from a variety of components to maintain the isolation and dependability of configurable hydraulic system 88. By way of example, valve switches 92 may be constructed as spool valves located within overall valve 90 to respond to a binary signal resulting from energization or de-energization of control valve 94. For example, energization of control valve 94 can enable introduction of pressurized fluid which transitions the valve switches 92 from one operational state to another. Similarly, de-energization of control valve 94 causes the reverse transition from one operational state to another. The valves 92, 94 and the valve switch 92 may also be configure for manual operation, as will be appreciated by those skilled in the art.

Furthermore, the design of configurable hydraulic system 88 also enables easy and automatic transition to the backup configurations of power delivery system 38, as discussed above and illustrated schematically in FIGS. 4 and 5. In the first backup configuration illustrated in FIG. 4, second prime mover 42 is deactivated but variable displacement hydraulic pumps 52 and 54 can be used to drive loads 44 and 48, respectively. In this example, configurable hydraulic system 88 is activated to the configuration illustrated in FIG. 8 and both hydraulic pumps 52 and 54 are operated to drive loads 44 and 48, respectively. In the second backup configuration illustrated in FIG. 5, first prime mover 40 is deactivated but variable displacement hydraulic pumps 58 and 60 can be used to drive loads 44 and 48, respectively. In this example, configurable hydraulic system 88 is activated to the configuration illustrated in FIG. 7 and both hydraulic pumps 58 and 60 are operated to drive loads 44 and 48, respectively.

Well system 20 may be constructed in a variety of configurations for use in many environments and applications. For example, power delivery system 38 may be designed to drive/supply power to well site surface equipment for performing well services operations, such as oilfield cementing units. However, the power delivery system 38 also may be designed to provide an automatically reconfigurable system able to supply power for operating many other types of loads including but not limited to, fracturing pumps/systems, liquid additive pumps/system, or other oilfield service units. Accordingly, the design of the prime movers and the types of loads driven can be adjusted to accommodate the particular operation to be performed. Regardless, the configurable hydraulic system 88 enables the existing combination of prime mover components and specific loads to be reconfigured while maintaining separate, sealed hydraulic systems for driving the loads. In many applications, the variable displacement hydraulic pumps enable desirable delivery of power to a variety of loads; however other pumps and devices also can be used to direct power to the loads.

Similarly, the configurable hydraulic system 88 may be adjusted to accommodate specific applications. For example, the valve switches may be formed from a variety of components for use in a single valve system or another suitable system. The configurable hydraulic system also may be designed to accommodate different numbers of prime movers and different numbers of loads. In many applications, the number of loads is at least one greater than the number of prime movers, however a variety of prime mover and load combinations may be employed. The configurable hydraulic system also may be designed to respond to a variety of signal inputs, including binary signals, and/or other types of signals that initiate automatic conversion of the configurable hydraulic system from one state/configuration to another. The configurable hydraulic system advantageously provides redundancy at the prime mover level (such as in case of prime mover failure or the like) by decoupling the functioning of one hydraulic system from the other.

Accordingly, although only a few embodiments of the present invention have been described in detail above, those of ordinary skill in the art will readily appreciate that many modifications are possible without materially departing from the teachings of this invention. Such modifications are intended to be included within the scope of this invention as defined in the claims.

What is claimed is:

1. A system for use in performing a well operation, comprising:

a configurable power delivery system comprising:

a first prime mover;

a second prime mover;

a first pump to pump cement slurry;

a second pump to pump cement slurry;

a third pump to pump cement slurry; and a separate, sealed hydraulic system associated with each of the first and the second prime movers, the separate, sealed hydraulic systems being adjustable to enable different combinations of the first pump, the second pump, and the third pump to be driven by the first prime mover and the second prime mover, respectively;

wherein at least one of the first and the second prime movers comprise at least a pair of variable displacement hydraulic pumps.

2. The system as recited in claim 1, wherein in a first normal operational configuration the pair of variable displacement hydraulic pumps of the first prime mover drives the second pump; one of the variable displacement hydraulic pumps of the second prime mover drives the first pump; and the other variable displacement hydraulic pump of the second prime mover serves as a backup for driving the third pump.

3. The system as recited in claim 1, wherein in a second normal operational configuration the separate, sealed hydraulic systems may be adjusted so the pair of variable displacement hydraulic pumps of the second prime mover drives the second pump; one of the variable displacement hydraulic pumps of the first prime mover drives the first pump; and the other variable displacement hydraulic pump of the first prime mover serves as a backup for driving the third pump.

4. The system as recited in claim 1, wherein in a first backup configuration the separate, sealed hydraulic systems may be adjusted to accommodate a power delivery configuration in which the second prime mover is inactive; one of the variable displacement hydraulic pumps of the first prime mover drives the first pump; and the other variable displacement hydraulic pump of the first prime mover drives the third pump.

5. The system as recited in claim 1, wherein in a second backup configuration the separate, sealed hydraulic systems may be adjusted to accommodate a power delivery configuration in which the first prime mover is inactive; one of the variable displacement hydraulic pumps of the second prime mover drives the first pump; and the other variable displacement hydraulic pump of the second prime mover drives the third pump.

6. The system as recited in claim 1, wherein the separate, sealed hydraulic systems are formed as a single valve having a plurality of valve switches.

7. The system as recited in claim 6, wherein the valve switches are activated by a binary signal.

8. The system as recited in claim 1, wherein the first, second, and third pumps are centrifugal pumps.

9. A method of performing a well operation, comprising:

forming a configurable power delivery system with two prime movers;

coupling the two prime movers to at least three pumps via a separate, sealed hydraulic system associated with each prime mover; and providing a signal to cause exchange of pumps that are driven by each prime mover while maintaining separate sealed hydraulic systems associated with each prime mover;

wherein forming comprises forming at least one of the two prime movers with a pair of variable displacement hydraulic pumps.

10. The method as recited in claim 9, wherein coupling comprises coupling the two prime movers to at least three centrifugal pumps.

11. The method as recited in claim 9, wherein forming comprises forming a first prime mover of the two prime movers with a pair of variable displacement hydraulic pumps.

12. The method as recited in claim 9, wherein forming comprises forming a second prime mover of the two prime movers with a pair of variable displacement hydraulic pumps.

13. The method as recited in claim 9, further comprising combining the separate sealed hydraulic systems into a single valve having a plurality of valve switches.

14. The method as recited in claim 13, further comprising operating the plurality of valve switches between de-energized and energized states with a binary signal.

15. The method as recited in claim 9, further comprising performing at least one well services operation with the pumps powered by the configurable power delivery system.

16. A system, comprising:

a power supply system having a plurality of prime movers to drive a plurality of loads, the number of loads being at least one greater than the number of prime movers, the power supply system comprising a hydraulic system that maintains a separate, sealed hydraulic system associated with each prime mover when the load configuration driven by each prime mover is automatically changed, and wherein each prime mover comprises at least a pair of variable displacement hydraulic pumps.

17. The system as recited in claim 16, wherein each prime mover comprises a power source.

18. The system as recited in claim 16, wherein each load of the plurality of loads comprises a pump.

19. The system as recited in claim 16, wherein the plurality of prime movers comprises two prime movers and the plurality of loads comprises three loads.

20. The system as recited in claim 19, wherein two loads are operated in each of a plurality of load configurations while a third load serves as a backup load.

21. A method, comprising:

connecting a plurality of prime movers to a plurality of loads with a hydraulic system; and arranging the hydraulic system such that each prime mover is associated with a separate, sealed hydraulic system regardless of which load is to be driven by each prime mover;

wherein at least one of the plurality of prime movers comprise at least a pair of variable displacement hydraulic pumps.

22. The method as recited in claim 21, further comprising changing the load configuration powered by the plurality of prime movers while maintaining the separate, sealed hydraulic system associated with each prime mover.

23. The method as recited in claim 21, wherein arranging comprises arranging the hydraulic system in a single valve having a plurality of valve switches operated with a binary signal.

24. The method as recited in claim 21, further comprising coupling the loads to wellsite surface equipment and performing at least one well services operation with the wellsite surface equipment.

* * * * *